US007762020B2

(12) United States Patent
Petridis et al.

(10) Patent No.: US 7,762,020 B2
(45) **Date of Patent: *Jul. 27, 2010**

(54) WALL-MOUNTED SLIDING DOOR SYSTEM AND METHOD

(75) Inventors: Georgios Petridis, Amaliada (GR); Jason M. Walsh, Batavia, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/041,008

(22) Filed: Mar. 3, 2008

(65) Prior Publication Data

US 2008/0209809 A1 Sep. 4, 2008

Related U.S. Application Data

(62) Division of application No. 10/891,453, filed on Jul. 15, 2004, now Pat. No. 7,350,332.

(51) Int. Cl.
*E05F 17/00* (2006.01)

(52) U.S. Cl. ..... 49/120; 49/370

(58) Field of Classification Search ..... 49/73.1, 49/95, 96, 116, 120, 122, 358, 370, 409, 49/100, 117, 118, 410, 449; 160/196.1
See application file for complete search history.

(56) References Cited

U.S. PATENT DOCUMENTS

| | | | | | |
|---|---|---|---|---|---|
| 1,766 | A | * | 9/1840 | Butterfield | 49/116 |
| 84,068 | A | * | 11/1868 | Reiher | 49/116 |
| 230,570 | A | * | 7/1880 | Prince | 49/95 |
| 489,442 | A | * | 1/1893 | Whetter | 49/100 |
| 522,936 | A | * | 7/1894 | Engel | 49/116 |
| 574,747 | A | * | 1/1897 | Metterhausen et al. | 49/116 |
| 575,162 | A | * | 1/1897 | Munderloh | 49/116 |
| 698,852 | A | * | 4/1902 | Pickop | 49/116 |
| 776,397 | A | * | 11/1904 | Howard et al. | 49/116 |
| 778,952 | A | * | 1/1905 | Cornell | 49/116 |
| 811,115 | A | * | 1/1906 | Ackerman | 49/116 |
| 814,434 | A | * | 3/1906 | Dahlund | 16/91 |
| 832,010 | A | * | 9/1906 | Cossey | 49/100 |
| 832,458 | A | * | 10/1906 | Cossey | 49/116 |
| 833,563 | A | * | 10/1906 | Stratta | 49/118 |
| 847,488 | A | * | 3/1907 | Metterhausen | 49/116 |
| 864,977 | A | * | 9/1907 | Metterhausen | 49/116 |
| 886,531 | A | * | 5/1908 | Metterhausen | 49/116 |
| 1,023,723 | A | * | 4/1912 | Cossey | 49/116 |
| 1,038,938 | A | * | 9/1912 | Murphy | 49/116 |
| 1,294,169 | A | * | 2/1919 | Roberts | 49/116 |
| 1,768,544 | A | * | 7/1930 | Conrad | 49/116 |
| 3,094,007 | A | * | 6/1963 | Luhrs | 74/422 |
| 4,588,049 | A | * | 5/1986 | Haas | 187/324 |
| 5,377,785 | A | * | 1/1995 | Pearson | 187/308 |
| 5,441,325 | A | * | 8/1995 | Toth et al. | 296/97.2 |
| RE35,622 | E | * | 10/1997 | Wilson | 296/97.2 |

* cited by examiner

*Primary Examiner*—Katherine W Mitchell
*Assistant Examiner*—Michael J Keller
(74) *Attorney, Agent, or Firm*—Berenato & White, LLC

(57) ABSTRACT

A sliding wall-mounted interior door system that includes a telescoping door actuating mechanism that is attached to the upper portion of the door, and a roller assembly that extends horizontally from the wall and engages a track in the lower portion of the door. The door actuating system is designed so that the movement of one of the door panels simultaneously moves the other door panel in the opposite direction. The actuating mechanism is designed so that a gearing assembly within the actuating mechanism moves laterally when the door system is moved between the open and closed positions.

20 Claims, 9 Drawing Sheets

WALL-MOUNTED SLIDING DOOR SYSTEM AND METHOD

CROSS-REFERENCE TO RELATED APPLICATION AND CLAIM TO PRIORITY

This application is a divisional of application Ser. No. 10/891,453, filed Jul. 15, 2004 (now U.S. Pat. No. 7,350,332), the disclosure of which is incorporated herein by reference and to which priority is claimed.

FIELD OF THE INVENTION

The invention generally relates to doors used in dwellings. Specifically, the invention relates to wall-mounted sliding interior doors having a top-hung actuating mechanism that causes the doors to move cooperatively.

BACKGROUND OF THE INVENTION

A typical interior door is comprised of a rectangular door hung by at least two hinges to a doorframe. The door pivots about the hinges to swing between the open and closed positions and thereby allow or prevent entry or departure from a room. Although conventional doors are well known, they have significant disadvantages. Sufficient area must exist in front of the door so that the door can swing outwardly. This limitation may reduce the available floor space in a room, or require that the door be opened into a traffic area. Double entry doors are also known, which require yet more space.

The prior art also includes a variety of sliding doors. The prior art sliding doors generally slide on a track at the top or the base of the doors. The most common sliding doors are comprised of a transparent material, such as glass, and are used as exterior doors. The most common interior sliding doors are pocket doors. While pocket doors do not have the space requirements of conventional hinged doors, pocket doors require a door track disposed above and/or below the door that extends twice the length of the door opening. Because of a pocket door's installed position within an interior wall, the doors are relatively expensive to install and may be difficult to repair if the sliding hardware associated with the door breaks or malfunctions after installation. Further, the disposition of the pocket door also makes it difficult to replace the door if an occupant wishes to redecorate a room or relocate the wall opening.

Additionally, both conventional hinged doors and conventional sliding doors are manufactured to specific sizes to accommodate standard-sized door openings. Since both types of conventional doors are manufactured to fit within the specific standard-sized openings, the size and shape of the doors are limited by the size and shape of the door openings. Also, manufactures must stock additional inventory to accommodate the various sizes, further increasing costs.

The need exists for an innovative door system that is not limited to standard-sized door openings, and that incorporates an actuation mechanism that is easily accessible for repair, or the replacement of the door panels. The invention discloses a wall-mounted sliding door that can be used with a range of door opening sizes. The door slides adjacent to the wall and thereby maximizes the space available within a room. The door does not require a lengthy floor or ceiling-mounted track that may become damaged or obstructed. The door actuating mechanism also allows the door system door panels to be easily replaced if an occupant intends to redecorate a room.

SUMMARY OF THE INVENTION

The invention comprises a sliding two-panel door system. The door system includes a telescoping door actuating mechanism that is disposed on a wall above the door opening. The actuating mechanism has at least two rails and a gearing assembly that rotatably connects to the two rails. Each of the rails is attached to one of the two door panels. When either one of the door panels is moved laterally, the gearing assembly also moves laterally. The door system is moved between the closed and open positions by moving one of the panels in a first direction and thereby causing the gearing assembly to propel the other door panel in the opposite direction.

The invention further comprises a two-panel door system with a telescoping door actuating mechanism mounted above a door opening. The two door panels may have a non-rectangular shape. The actuating mechanism includes at least a top rail and an intermediate rail with a gearing assembly interconnecting the top rail with the intermediate rail. The upper portion of the first door panel is attached to the top rail and the upper portion of the second door is attached to the intermediate rail. When one of the door panels moves laterally, the gearing assembly also moves laterally. The gearing assembly has a 2:1 gear ratio. The door system also includes rollers positioned on each side of the door opening. The rollers extend horizontally and engage a roller track positioned on the bottom portion of each of the door panels. The rollers provide additional vertical support for the door system and facilitate the lateral movement of the door panels. The door system is moved between the closed and open positions by moving one of the panels in a first direction thereby causing the gearing assembly to propel the other door panel in the opposite direction.

The invention also comprises a sliding interior door apparatus for a door opening in a wall comprising a telescoping door actuating mechanism extending above a door opening and attaching to a wall. The upper portions of the first and second door panels are attached to the door actuating mechanism. The door system also includes first and second rollers positioned on each side of the door opening. The rollers extend horizontally and engage first and second roller tracks positioned in a slot on the bottom portion of each of the door panels. The rollers provide additional vertical support for the door system and facilitate the lateral movement of the door panels. The door system is moved from a closed position to an open position by applying a force to one of the door panels. When a force is applied to the first door panel then the first door panel moves in a first direction away from the second door panel so that the actuating mechanism telescopes in the first direction to allow the first door panel to slide away for the centerline of the door opening in the first direction. The door actuating system simultaneously telescopes in a direction opposite the first direction and propels the second door panel in the opposite direction of the first door panel so that the door system is moved to the open position and the door opening is uncovered.

The invention further comprises a method of operating sliding doors. Two sliding door panels are attached to two sliding rails. A gearing assembly interconnects the sliding rails. A motive force is applied to a selected door panel, thereby moving the selected door panel laterally and causing the gearing assembly to also move laterally. The gearing assembly simultaneously directs the force to the non-selected door panel so that the non-selected door panel moves in the opposite direction of the selected door panel and thereby causes the selected and non-selected door panels to move in opposite directions. The movement of the door panels in opposite directions allows the door panels to diverge and converge and thereby causes the door to move between open and closed positions.

DETAILED DESCRIPTION OF THE PREFERRED EMBODIMENTS

Figure 1:
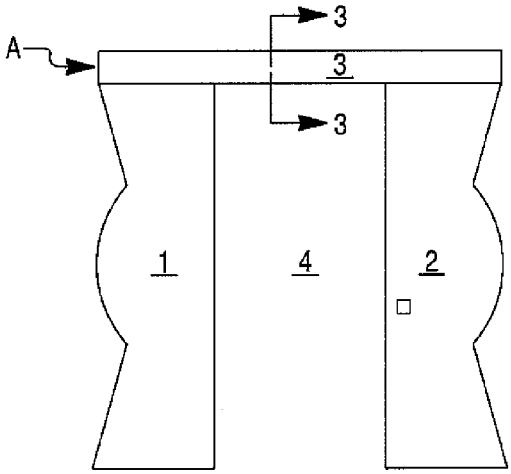
FIG. 1 is an elevational front view of the door system of the present invention in the open position.
Figure 2:
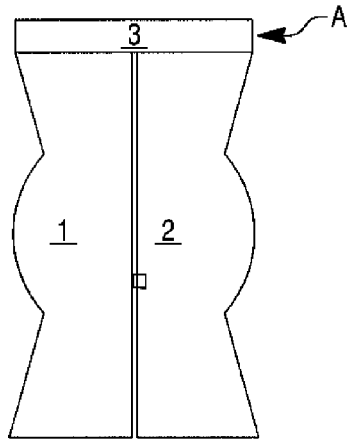
FIG. 2 is an elevational front view of the door system in the closed position.

As best shown in FIGS. 1-2, the current invention is a two-panel wall-mounted sliding door system. FIG. 1 shows the doors in the open position permitting passage through the opening in a wall, and FIG. 2 shows the doors in the closed position. The invention is comprised of first 1 and second 2 sliding door panels extending vertically downwardly from a telescoping door actuation mechanism A to the floor.

The door actuating mechanism A includes a decorative cover 3 that is disposed on the outside of the actuating mechanism A. As best shown in FIG. 1, the cover 3 is extendable to accommodate the expanded area spanned by the door panels 1, 2 in the open position. When the door panels 1, 2 move to the closed position of FIG. 2, the cover 3 retracts to accommodate the retracted door actuating mechanism A. The cover may be comprised of a stretchable fabric that simply stretches and retracts when the door opens and closes, or it may be comprised of other materials such as leather, non-stretchable fabric, plastic, wood, metal, a composite material, or the like, either alone or in combination with a stretchable fabric. The cover may expand and contract in a telescoping or accordion manner, or by any other means known in the art.

As best shown in FIGS. 3*a*-3*d*, various configurations of horizontal support structures are used to support to the door system, stabilize the bottom portion of the door panels, and facilitate the lateral movement of the door panels 1, 2. In the preferred embodiment shown in FIG. 3*a*, a roller assembly 8 extends horizontally from the wall 6 and engages a roller track 10 in the bottom portion of each of the door panels 1, 2. The roller assembly 8 may be comprised of at least a circular roller attached to the end of a roller support. The roller track 10 is positioned either within the bottom portion of the door, or alternatively the roller track may extend horizontally from the bottom portion of the door. The specific structure of the roller assembly 8 may include any rolling or sliding mechanism known in the art that vertically supports the door panels 1, 2 and facilitates the lateral sliding motion of the door panels 1, 2. The roller assembly 8 and roller track 10 maintain vertical alignment of the door panels 1, 2 parallel to wall 6.

Figure 3A:
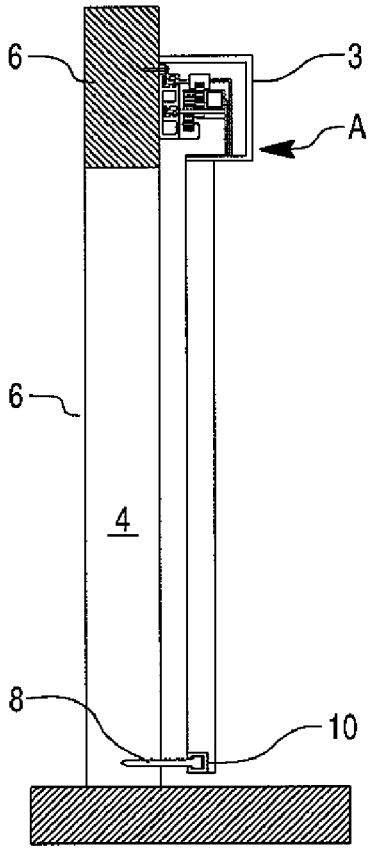
FIGS. 3*a*-3*d* are cross-sectional views of various embodiments taken along the line 3-3 shown in FIG. 1 and looking in the direction of the arrows.
Figure 3B:
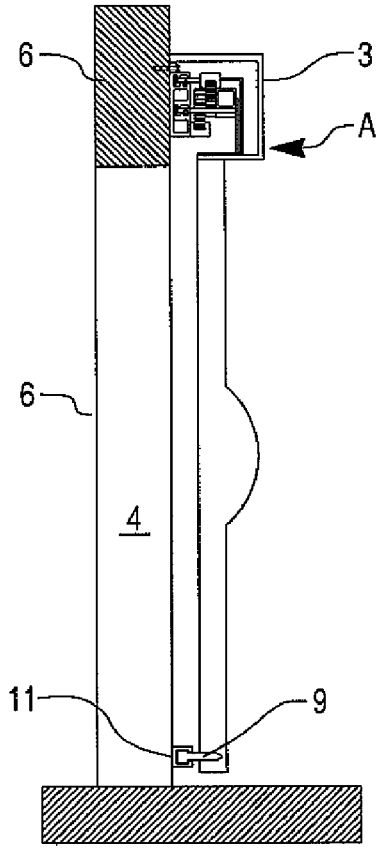
Figure 3C:
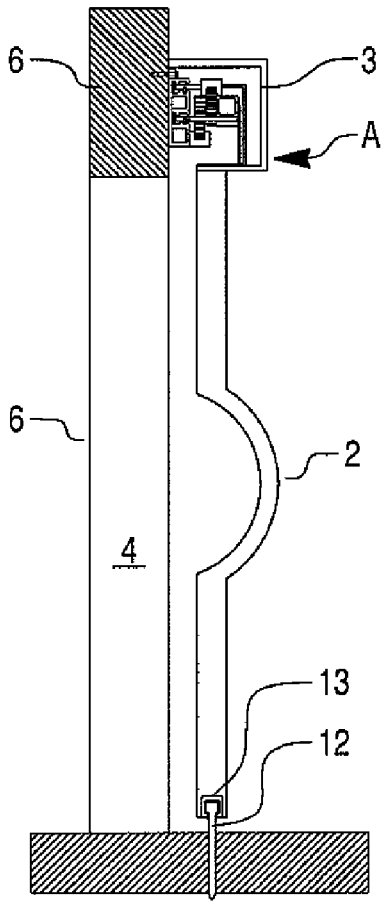
Figure 3D:
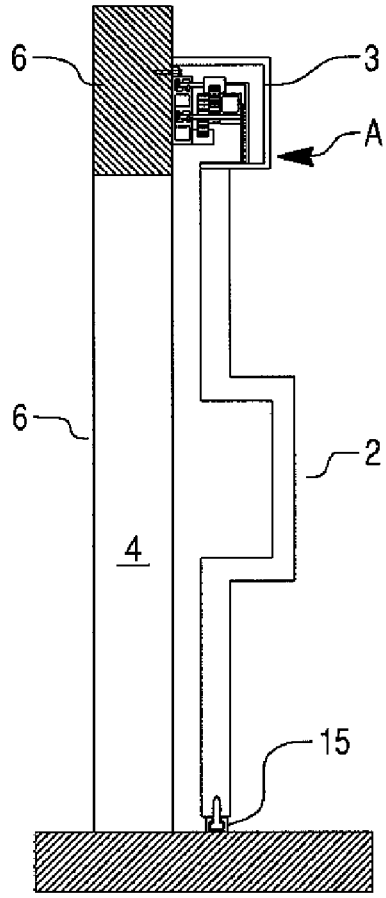

In an alternative embodiment of the horizontal support structure described above, a door-mounted roller assembly 9 extends horizontally from the bottom portion of each of the door panels 1, 2 and engages a wall-mounted roller track 11 positioned on the wall 6, as best shown in FIG. 3*b*. In an additional alternative embodiment best shown in FIG. 3*c*, a floor-mounted roller assembly 12 extends upwardly so that the roller assembly 12 engages a roller track 13 positioned on the bottom of the door panels 1, 2. In the alternative embodiment shown in FIG. 3*d*, the roller track has been removed so that a roller assembly 15 extends vertically downward from a bottom portion of the door panels 1, 2 and engages the floor. In yet an additional embodiment, the support assembly hardware may be removed so that the door panels 1, 2 are supported solely by the door actuating mechanism A attached to the upper portion of the door panels 1, 2.

Figure 4:
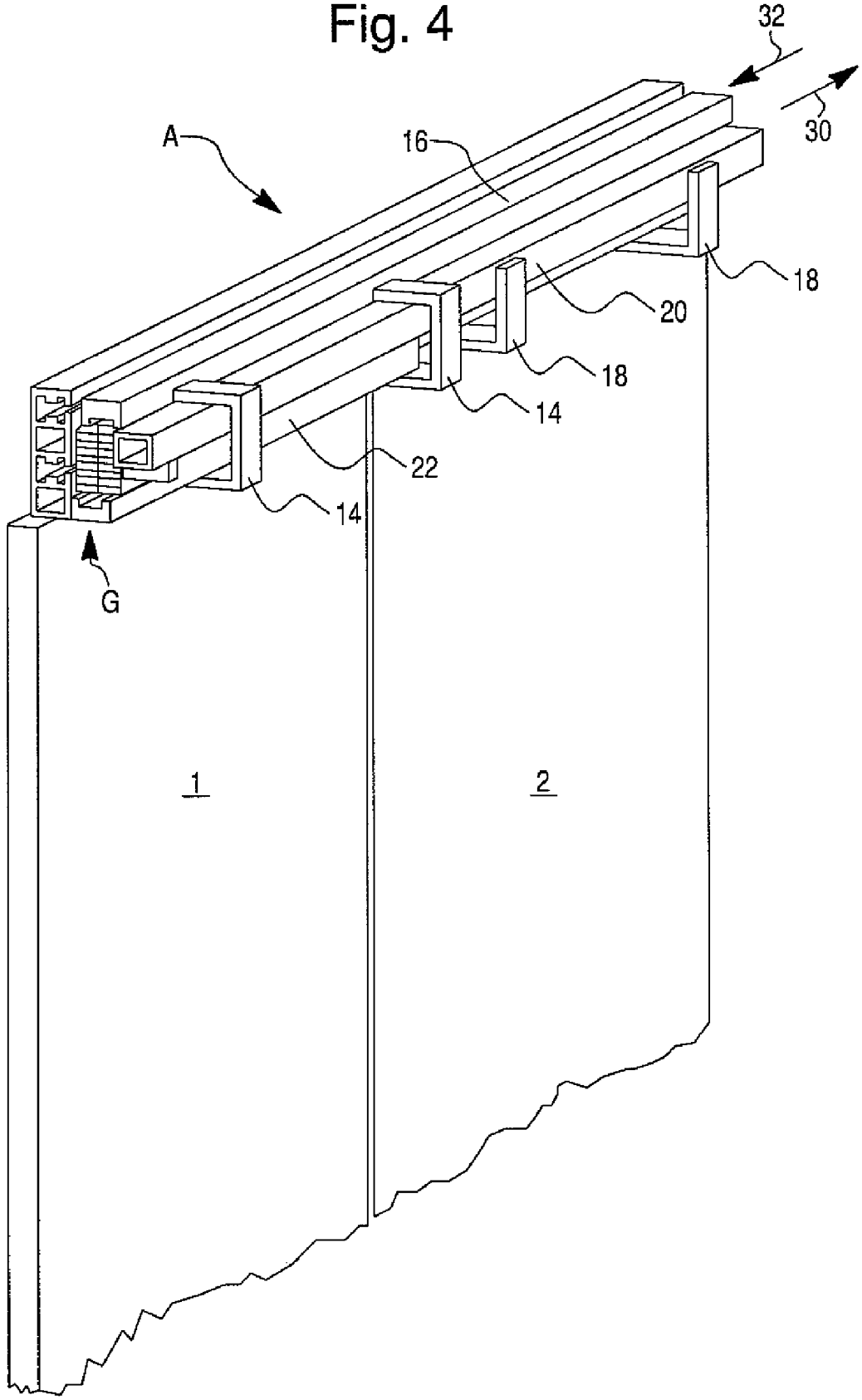
FIG. 4 is a fragmentary perspective view of the present invention with the cover for the door actuation mechanism removed.

As best shown in FIGS. 1-4, because the door panels 1, 2 are mounted in front of the door opening 4, rather than within the opening 4, the size, shape, and configuration of the panels 1, 2 are not limited by the dimensions or shape of the door opening 4. This aspect of the invention gives an occupant of a dwelling much greater flexibility in determining the size, and shape of the door panels 1, 2. The door panels 1, 2 may be rectangular as shown in FIG. 4, or non-rectangular as shown in FIGS. 1 and 2. Similarly, the panels 1, 2 may be planar as shown in FIG. 3*a*, or non-planar as shown in FIGS. 3*b* and 3*c*. As best shown in FIG. 3*b*, the panels 1, 2 may have one side that is planar and one side that is non-planar, or both sides may be non-planar, as best shown in FIGS. 3*c* and 3*d*. Additional variations and combinations of the above door panel configurations should be considered within the scope of the invention.

The flexibility of the door system described above is her enhanced because, with the decorative cover 3 removed, the door actuating mechanism A is fully exposed thereby allowing the easy removal and replacement of the door panels 1, 2 during a renovation or redecorating process. Access to the door panels 1, 2 allows an occupant to change the shape, size, style or colors of the door panels as a room is redecorated or the furniture is replaced. This increased flexibility allows the door system to become a variable aspect of the room furnishings rather than a fixed and non-variable component.

As best shown in FIG. 4, the actuating mechanism A includes top brackets 14 that extend from a top railing 16 to the first door panel 1, and intermediate brackets 18 that extend from an intermediate rail 20 to the second door panel 2. A gearing assembly G interconnects the top rail 16 with the intermediate rail 20 and stationary rail 22. The brackets 14, 18 extend downwardly and then back under the actuating mechanism A so that the door panels extend vertically beneath the actuating mechanism A.

Figure 5:
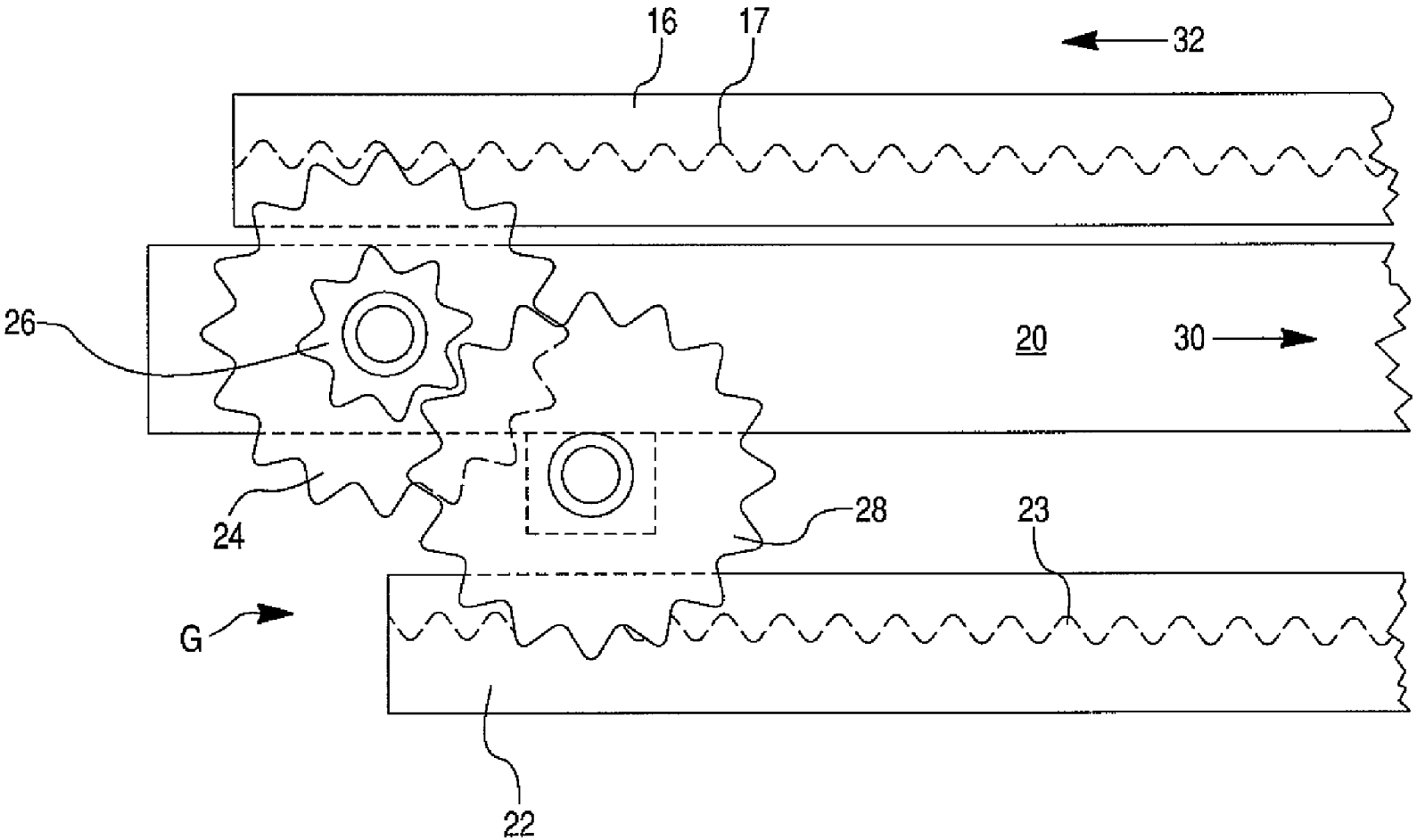
FIG. 5 is a fragmentary elevational view of the gearing assembly of the invention.

As best shown in FIG. 5, the gearing assembly G is comprised of a first gear 24 that meshes with gear teeth 17 on the top rail 16. A second gear 26 extends outwardly from the center portion of the first gear 24 and meshes with a third gear 28. In the preferred embodiment, the second gear 26 has half the diameter of the first 24 and third 28 gears so that the gearing assembly G has a gearing ratio of 2:1, i.e. the first gear 24 rotates at twice the rate of the third gear 28 when the gearing system G is engaged. The third gear 28 meshes with the teeth 23 of the stationary rail 22. All three gears 24, 26, 28 of the gearing assembly G are connected to the intermediate rail 20 so that when the intermediate rail moves from left to right in FIG. 5, the gearing assembly G also moves from left the right. While a 2:1 gearing ratio is preferred, other gearing ratios are potentially usable.

As best shown in FIGS. 4 and 5, to open the door panels 1, 2, a force is applied to the first 1 or second 2 door panel to move one of the door panels 1, 2 in the opposite direction of the other door panel. If the force is applied to the second door panel 2, the force is communicated through the intermediate brackets 18 attached to the second door panel 2 to the intermediate rail 20. As the second door panel 2 and attached intermediate rail 20 move away from the first door panel 1, the intermediate rail 20 also moves the gearing assembly G in the same direction, as indicated by the arrows 30 in FIGS. 4 and 5.

As best shown in FIG. 5, as the gearing assembly G moves in the direction of the arrow 30, the third gear 28 engages the teeth on the stationary rail 22, which imparts a clockwise rotational force to the third gear 28. The rotary force generated by the third gear 28 communicates through the second gear 26 to the first gear 24 so that the first 24 and second 26 gears rotate in a counter-clockwise direction. The first gear 24 engages the teeth 17 on the top rail 16 and imparts a horizontal force to the top rail 16 in the direction indicated by the arrow 32. As a result of the gearing between the second 26 and third 28 gears, the counter-clockwise rotation of the first gear 24 propels the top rail 16 and attached first door panel 1 in a direction opposite of the movement of the intermediated rail 20.

The 2:1 gear ratio of the gearing assembly G is required to move the first door panel 1 in the opposite direction of the second door panel 2 at the same horizontal speed as the second door panel 2. As described above, the second door panel 2, gearing assembly G, and intermediate rail 20 are all directly connected and move together. As the gearing assembly G and associated components move (to the right in FIGS. 4 and 5 during the opening process), the movement causes the gearing assembly G to rotate the first gear 24 in the opposite direction of the third gear 28 at twice the rate of the third gear 28. The rotation of the first gear 24 imparts a horizontal force to the top rail 16 and causes first door panel 1 to move to the left away from the door opening 4 centerline even as the first gear 24 and the rest of the gearing assembly 26, 28 move to the right. The 2:1 gear ratio allows the top rail 16 and attached first door panel 1 to move in the opposite direction of the gearing assembly G and attached second door panel 2 at the same horizontal speed as the second door panel 2, and thereby allows the first door panel 1 to reach the fully open (or closed) position at the same time that the second panel 2 reaches the corresponding position.

Figure 6:
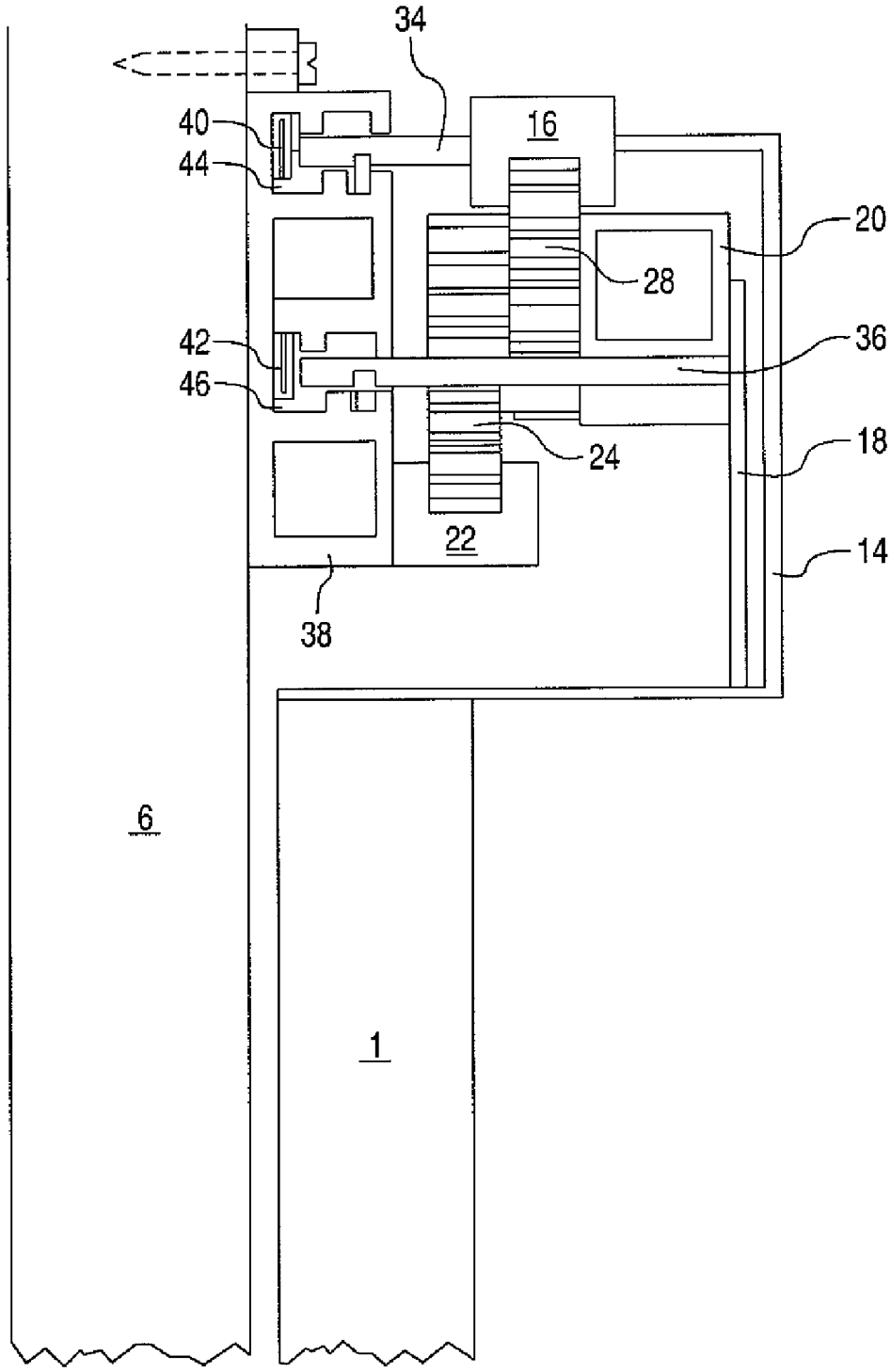
FIG. 6 is a fragmentary elevational view of the door actuating mechanism mounted on the wall with the cover removed.

As best shown in FIG. 6, the top rail 16 and the intermediate rail 20 are attached to top 34 and intermediate 36 lateral supports, respectively. The top 34 and intermediate 36 lateral supports extend horizontally between the rails 16, 20 and a primary base unit 38, which may be attached to the wall 6 by suitable mechanical fasteners. Roller assemblies 40, 42 are rotatably connected to the ends of the top 34 and intermediate 36 supports. The roller assemblies 40, 42 travel in roller tracks 44, 46 disposed within the primary base unit 38 and provide support for the rails 16, 20. Both the top 16 and intermediate 20 rails have at least one lateral support 34, 36 extending between the primary base unit 38 and each of the rails 16, 20.

Figure 7:
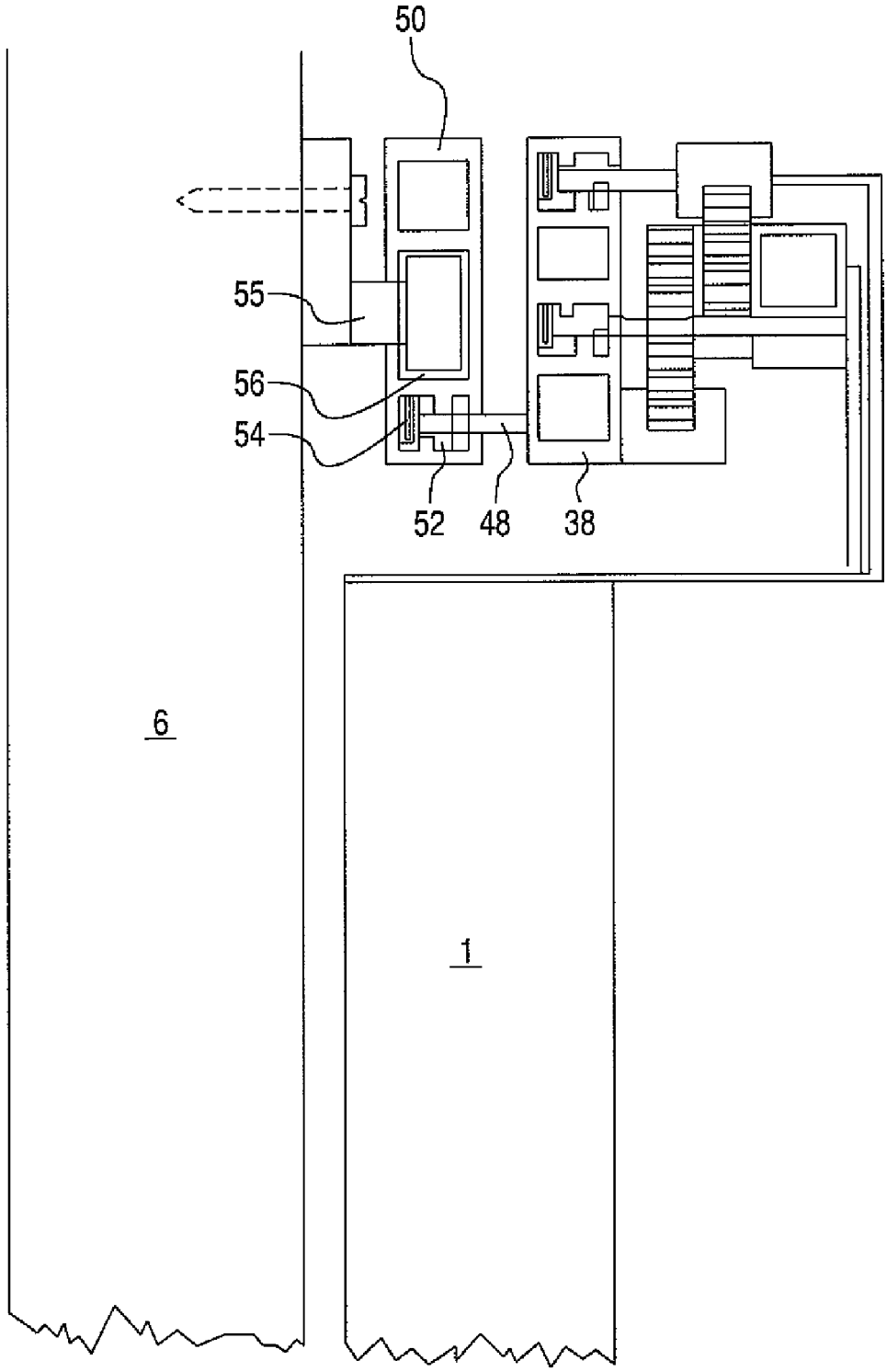
FIG. 7 is a fragmentary elevational view of an alternative embodiment of the door actuating mechanism mounted on the wall with the cover removed.
Figure 8:
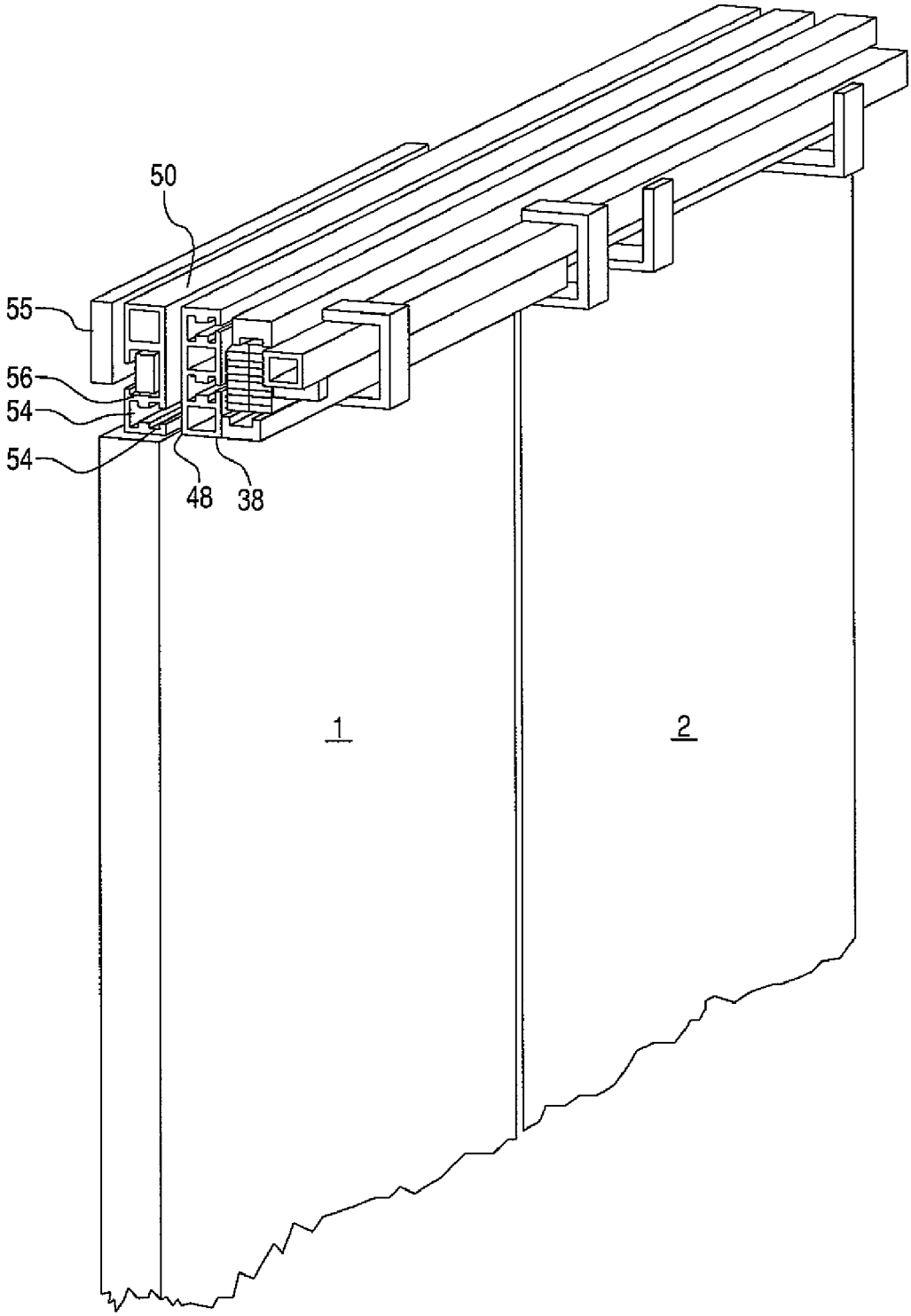
FIG. 8 is a fragmentary perspective view partially in section of the alternative embodiment shown in FIG. 7 with the cover removed.
Figure 9:
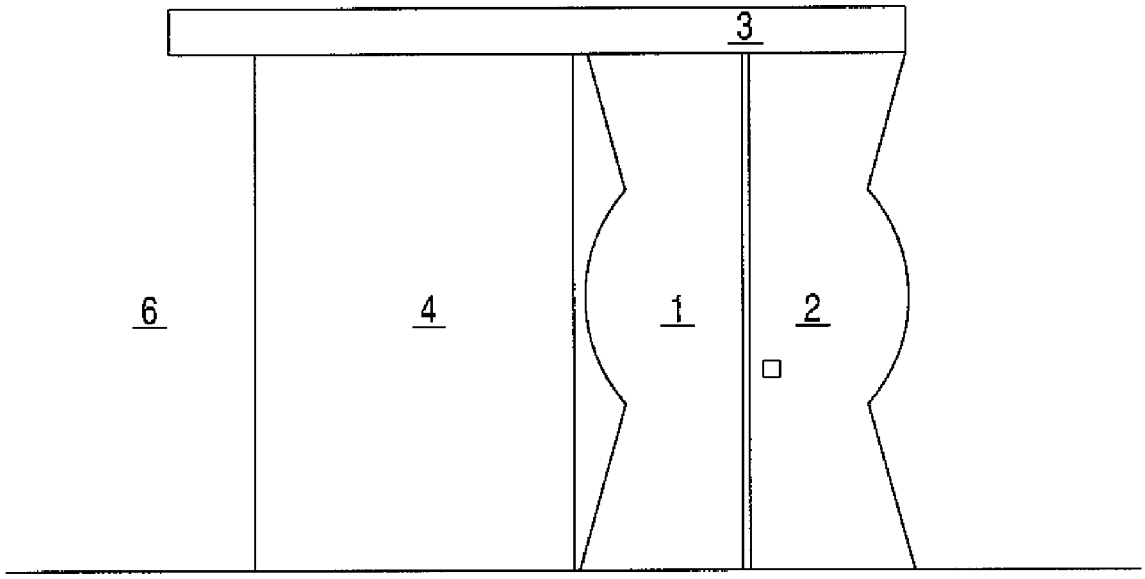
FIG. 9 is a front elevational view of the alternative embodiment shown in FIGS. 7 and 8.

As best shown in FIGS. 7-9, multiple alternative embodiments are within the scope of the invention. The alternative embodiments may include a locking system with the capability of locking and unlocking the top 16 and intermediate 20 rails with the stationary rail 22, so that the door panels 1, 2 maintain a position in which the first panel 1 abuts the second panel 2. The locking system may also lock and unlock the base unit 38 with an extended base unit 50. The locking system may further lock and unlock the extended base unit 50 with a wall support bracket 55. The actual mechanical locking of the components described above may be achieved by any method known in the art.

As best shown in FIGS. 7-9, in a first alternative embodiment, the primary base unit 38 includes at least one base lateral support 48 that connects the primary base unit 38 with an extended base unit 50. Similar to the configuration described above, the extended base unit 50 includes a roller track 52 that accommodates at least one roller 54 disposed at the end of the each base lateral support 48.

When the top 16 and intermediate rails are locked together with the stationary rail and the base unit is 38 unlocked from the extended base unit 50, the door panels 1, 2 may move in unison in the same direction. As the base lateral support rollers 54 travel in the extended base unit roller track 52, the primary base unit 38 and connected door panels 1, 2 move in unison and slide between positions in front of and away from the door opening 4, thereby effectively moving the door system between open and closed positions. FIG. 9 shows the alternate embodiment configurations of the door system in the open position.

In an additional alternative embodiment also best shown in FIGS. 7-9, the extended base unit 50 is slidingly mounted to a wall support bracket 55, which extends into a slot 56 in the extended base unit 50. When the wall support bracket 55 is unlocked from the extended base unit 50, and the extended base unit 50 is locked with the primary base unit 38, then the extended base unit 50, the primary base unit 38, and the connected door panels 1, 2 may move in unison and slide between positions in front of and away from a door opening 4, thereby effectively moving the door system between open and closed positions. Although a sliding rail connection is shown between the wall support bracket 55 and the extended base unit 50, other types of sliding connections, such as a roller assembly connection, should also be considered within the scope of the invention.

In a further alternative embodiment also shown in FIGS. 7-9, the extended base unit 50 may be unlocked from both the wall support bracket 55 and the primary base unit 38. In this configuration, the extended base unit 50, and the attached primary base unit 38 and door panels 1, 2, slide horizontally on the wall support bracket 55 (to the right in FIGS. 8 and 9) in unison away from the door opening 4. Once the extended base unit 50 and attached components reach the longitudinal end of the wall support bracket 55, the primary base unit 38 telescopes outwardly away from the extended base unit 50 to slide even further to the right as the base lateral support rollers 54 travel in the extended base unit roller track 52, as shown in FIG. 7 and as described above in a previous embodiment. The telescoping movement of the primary base unit 38 allows the primary base unit 38 and connected door panels 1, 2 to move even further away from the door opening 4 so that an enlarged door opening 4 may be completely uncovered and covered.

For the foregoing reasons, it is clear that the present invention provides an innovative door system. The preferred embodiment of the door system includes two door panels 1, 2 extending vertically from a telescoping door actuation mechanism A that simultaneously moves both door panels 1, 2 in opposite directions so that the door system moves between closed and open positions. The door panels 1, 2 are disposed in front of the door opening 4 rather than within the door opening 4 so that the size and shape of the door opening 4 does not limit the size and shape of the door panels 1, 2. The telescoping door actuating mechanism A does not rely on ceiling or floor-mounted tracks for smooth movement and vertical support. The actuating mechanism A is readily accessible for repair or for the replacement of the door panels 1, 2 if an occupant intends to redecorate a room.

The invention, as described, may be modified in multiple ways and applied in various technological applications. Although the invention is primarily directed to a door for a dwelling, the invention may also have application in other types of environments and technologies. Similarly, although the materials of construction are not described, they may include a variety of compositions consistent with the function of the invention. Such variations are not to be regarded as a departure from the spirit and scope of the invention, and all such modifications as would be obvious to one skilled in the art are intended to be included within the scope of the following claims.

We claim:

1. A sliding door system, comprising:

a base unit for mounting above an opening in a wall;

said base unit comprising a first guide track extending laterally and a second guide track extending laterally adjacent to said first track;

at least first and second rails movably supported by said base;

a first door panel attached to said first rail;

a second door panel attached to said second rail;

a lateral movement assembly operably engaged between said rails so that moving one of said rails causes said rails to move laterally in opposite directions, said lateral movement assembly being operatively attached to said one of said rails so that moving said one of said rails moves said lateral movement assembly laterally with said one of said rails;

a first lateral support having a first end and a second end opposite said first end, said first end being attached to said first rail;

a first roller assembly attached to said second end of said first lateral support, said first roller assembly being disposed in said first guide track to guide movement of said first lateral support, said first rail, and said first door panel;

a second lateral support having a first end and a second end opposite said first end, said first end being attached to said second rail; and a second roller assembly attached to said second end of said second lateral support, said second roller assembly being disposed in said second guide track to guide movement of said second lateral support, said second rail, and said second door panel, wherein said door panels are moved between an open and a closed position by moving one of said door panels laterally in a first direction thereby causing said lateral movement assembly to propel the other one of said door panels in a second direction opposite from the first direction.

2. The sliding door system of claim 1, wherein said lateral movement assembly comprises a gear assembly rotatably attached to one of said rails.

3. The sliding door system of claim 2, further comprising:

a stationary rail fixed to said base unit for movably supporting said gear assembly, said stationary rail having teeth for intermeshing with said gear assembly.

4. The sliding door system of claim 1, wherein said lateral movement assembly comprises:

a first gear;

a second gear extending from a center portion of said first gear, said second gear having a smaller diameter than said first gear; and a third gear meshing with said second gear so that rotating said third gear causes said first gear to rotate at a faster rate and in an opposite direction than said third gear, wherein said first, second, and third gears are connected to, and move laterally with said second rail, and said first rail has gear teeth that mesh with said first gear so that moving said second rail laterally causes said first rail to move laterally in a direction opposite said second rail.

5. The sliding door system of claim 1, further comprising:

first and second guiding elements disposed on bottom portions of said first and second door panels, said guiding elements engaging the wall on outer sides of the opening or the floor underneath the first and second door panels.

6. The sliding door system of claim 5, wherein said first and second guiding elements comprise first and second roller assemblies extending vertically from the respective bottom portions of the first and second door panels and engaging a roller track extending from a floor surface, the first and second roller assemblies vertically supporting said first and second door panels while permitting movement of said first and second door panels.

7. A sliding door system, comprising:

a wall support bracket;

a first base unit connected to said wall support bracket and moveable with respect thereto;

a second base unit connected to said first base unit and moveable with respect to said wall support and said first base unit;

at least first and second rails movably supported by said second base unit;

a first door panel attached to said first rail;

a second door panel attached to said second rail; and a lateral movement assembly operably engaged between said rails, said lateral movement assembly allowing first and second door panels to move along a lateral axis parallel to the major plane of the opening in the wall to open and close the opening in the wall, said lateral movement assembly being operatively attached to one of said rails so that moving said one of said rails moves said lateral movement assembly laterally.

8. The sliding door system of claim 7, wherein said lateral movement assembly comprises a gear assembly attached to said second rail so that lateral movement of said second rail causes lateral movement of said first or second door panels in opposite directions.

9. The sliding door system of claim 7, further comprising:

a locking system for locking and unlocking the first and second rails with respect to one another to prevent the first and second door panels from moving relative to one another.

10. The sliding door system of claim 9, wherein:

the first base unit comprises a guide track extending in a lateral direction, and a roller assembly is disposed in said guide track to allow the second base unit to move laterally with the first and second door panels along the wall.

11. The sliding door system of claim 7, further comprising:

a covering element covering said first and second rails, lateral movement assembly, and base unit, the covering element having a retractable shape for expanding when said first and second rails move away from one another to open said first and second door panels and retracting when said first and second rails move close together to close said first and second door panels.

12. The sliding door system of claim 7, wherein said first and second door panels have at least one non-planar surface.

13. The sliding door system of claim 7, wherein said first and second door panels are non-rectangular.

14. The sliding door system of claim 7, further comprising:

a first support assembly extending horizontally from the wall on a first side of the opening, said first support assembly engaging a bottom portion of said first door panel;

a second support assembly extending horizontally from the wall on a second side of the opening, said second support assembly engaging a bottom portion of said second door panel, wherein said first and second support assemblies guide movement of said first and second door panels between open and closed positions by stabilizing and supporting said bottom portions of said first and second door panels.

15. A telescoping door actuation mechanism usable with a sliding door for movably supporting first and second door panels in front of an opening in a wall so that the opening is closed and opened by moving the first and second door panels, said actuation mechanism comprising:

a base unit mountable above the opening in the wall;

at least first and second rails movably supported by said base unit for lateral movement above the opening, said first and second rails for supporting the first and second door panels, respectively; and a lateral movement assembly having a gearing assembly rotatably attached to one of said rails, wherein the base unit and the lateral movement assembly combine to allow the doors to be selectively moved together in either lateral direction with respect to the opening as well as moved away from the opening in opposite directions.

16. The door actuation mechanism of claim 15, further comprising:

at least first and second brackets extending downwardly from said first and second rails, respectively, said first and second brackets for attachment to top portions of the first and second door panels, respectively, wherein when one of said brackets and the associated rail are moved in a first direction, said gearing assembly propels the other one of said brackets and the associated rail in a second direction opposite to the first direction.

17. The door actuation mechanism of claim 16, further comprising:

a stationary rail supported by said base unit, said stationary rail having gear teeth intermeshing said gearing assembly so that said first and second rails are movable with respect to said stationary rail by moving said gearing assembly.

18. The door actuation mechanism of claim 16, wherein said gearing assembly comprises:

a first gear rotatably attached to said second rail;

a second gear extending from a center portion of said first gear, said second gear having a smaller diameter than said first gear; and a third gear meshing with said second gear so that rotating said third gear causes said first gear to rotate at a faster rate and in an opposite direction than said third gear, wherein said first, second, and third gears are connected to, and move laterally with said second rail, and said first rail has gear teeth that mesh with said first gear so that moving said second rail laterally causes said top rail to move laterally in a direction opposite said second rail.

19. The door actuation mechanism of claim 15, wherein the base unit comprises:

a wall mount;

a first base connected and moveable with respect to the wall mount; and a second base unit connected to the first base unit and moveable with respect to the wall mount.

20. The door actuation mechanism of claim 15, further comprising a locking mechanism which prevents the first and second door from moving with respect to one another but allows them to move with respect to the opening.

* * * * *